US009777949B2

(12) United States Patent
Gong

(10) Patent No.: US 9,777,949 B2
(45) Date of Patent: Oct. 3, 2017

(54) REFRIGERATION APPARATUS

(71) Applicant: Bingxin Gong, Guangzhou (CN)

(72) Inventor: Bingxin Gong, Guangzhou (CN)

( * ) Notice: Subject to any disclaimer, the term of this patent is extended or adjusted under 35 U.S.C. 154(b) by 102 days.

(21) Appl. No.: 14/656,718

(22) Filed: Mar. 13, 2015

(65) Prior Publication Data

US 2015/0184897 A1 Jul. 2, 2015

Related U.S. Application Data

(63) Continuation-in-part of application No. PCT/CN2013/082036, filed on Aug. 22, 2013.

(30) Foreign Application Priority Data

Sep. 13, 2012 (CN) ..... 2012 1 0344608

(51) Int. Cl.

| | |
|---|---|
| ***F25B 1/00*** | (2006.01) |
| ***F25B 41/04*** | (2006.01) |
| ***F01B 23/10*** | (2006.01) |
| ***F25B 1/02*** | (2006.01) |
| ***F25B 11/00*** | (2006.01) |

(52) U.S. Cl.

CPC ..... *F25B 1/00* (2013.01); *F01B 23/10* (2013.01); *F25B 1/02* (2013.01); *F25B 11/00* (2013.01); *F25B 41/04* (2013.01)

(58) Field of Classification Search

CPC .. F25B 1/00; F25B 1/02; F25B 31/023; F25B 2700/06; F04B 35/00; F04B 23/06; F01B 23/10; F01B 23/08

See application file for complete search history.

(56) References Cited

U.S. PATENT DOCUMENTS

| | | | | |
|---|---|---|---|---|
| 3,823,573 | A * | 7/1974 | Cassady | F04B 13/02 62/116 |
| 2007/0251379 | A1* | 11/2007 | Lund | F01B 15/04 92/140 |
| 2008/0141688 | A1* | 6/2008 | Stanke | B60H 1/3204 62/149 |
| 2011/0203304 | A1* | 8/2011 | Sato | F04B 39/062 62/324.6 |

FOREIGN PATENT DOCUMENTS

KR 10-2010-0042969 * 4/2010

* cited by examiner

*Primary Examiner* — Elizabeth Martin

(57) ABSTRACT

A refrigeration apparatus includes a compressor, two or more cylinders coupled with the compressor, and an airproof container enclosing the cylinders and filled with air or other gas. Each cylinder is provided with a piston, an inlet valve coupled with the compressor, and an outlet valve coupled with a condenser. When inlet valves are open, outlet valves are closed, and pistons move from bottom to top of cylinders, refrigerant flows from compressor into cylinders through inlet valves; and when inlet valves are closed and outlet valves are open, refrigerant flows from cylinders into condenser through outlet valves. Then, air pressure in cylinders drops, and pressure in airproof container forces pistons to move to the bottom of cylinders. The pressure in airproof container is utilized by cylinders to produce electrical energy.

11 Claims, 2 Drawing Sheets

REFRIGERATION APPARATUS

CROSS REFERENCE TO RELATED APPLICATIONS

The present application is a Continuation-In-Part Application of PCT application No. PCT/CN2013/082036 filed on Aug. 22, 2013, which claims the benefit of Chinese Patent Application No. 201210344608.7 filed on Sep. 13, 2012. All the above are hereby incorporated by reference.

FIELD OF THE INVENTION

This invention is of a new type of refrigeration apparatus. For its cycle the working substance is ammonia or chloromethane or the other refrigerants. The new type of refrigeration apparatus has the following main parts: a compressor, a condenser, an expansion valve, an evaporator, a three-port valve or a multi-port valve, a generator, a cylinder unit, an airproof container. The atmospheric pressure of the airproof container can be utilized by its cylinder unit. This pressure will provide the electrical energy and compensate for the power consumption of the compressor, so it can save the electrical energy.

BACKGROUND OF THE INVENTION

As we know, the world is facing an energy and climate crisis, and conventional refrigeration apparatuses consume large amounts of power, as the atmospheric pressure cannot be utilized in conventional refrigeration apparatuses, which worsens this problem.

SUMMARY OF THE INVENTION

In order to solve the above mentioned problems, a new type of refrigeration apparatus is provided by the present invention, which comprising the following main parts: a compressor 3, a condenser 10, an expansion valve 1, an evaporator 2, a three-port valve 4 or a multi-port valve, a generator 100, a cylinder unit 1, 2, an airproof container 11, and new-style cylinders 35, 36, valves 26, 27, 28, 29, shifting yokes 52 and stoppers 62.

Its refrigerant flows through the following main parts: the compressor 3, the three-port valve 4 or the multi-port valve, the cylinder unit 1, 2, the condenser 10, the expansion valve 1, the evaporator 2, and into the compressor 3 from the evaporator 2. The atmospheric pressure 8 of the airproof container 11 can be utilized by the cylinder unit 1, 2. The work of the atmospheric pressure will produce the electrical energy and compensate the power consumption of the compressor. The thermodynamics cycle is a refrigeration cycle.

The cylinder unit 1, 2 is installed in an airproof container 11, which can exchange heat with the environment. The airproof container 11 is filled with air or other gas. According to the environmental temperature, the pressure of the airproof container 11 and the pressure of the compressor's outlet should be adjusted: the atmospheric pressure of the airproof container 11 is equal to, or higher than, the refrigerant's liquefied pressure at the environmental temperature. The atmospheric pressure of the airproof container 11 is equal to, or lower than, that of the compressor's outlet.

Its cylinder unit consists of cylinder 1 and cylinder 2, or more cylinders could be added. Due to the cylinder needing time to process, the intake stroke and the outlet stroke, one cylinder alone cannot allow the new type of refrigeration apparatus to work continuously. The volume of the cylinder depends on the difference of flux between the compressor's outlet and the expansion valve 1, the greater difference of flux, the greater the volume of cylinder; the number of cylinders required, depends on the cooling rate of the condenser, the faster cooling rate, the fewer cylinders are required.

To maintain the temperature of the cylinder, the refrigerant needs to reduce the condensation loss, as the material of the cylinders is a heat insulator. The structure of each cylinder is the same, and every cylinder 1, 2 has both an inlet valve 16, 17 and outlet valve 18, 19. The inlet valves 16, 17 may be provided on inlet pipes 12, 13 extending between the compressor 3 and the cylinders 1, 2 respectively, and a mechanism may drive the inlet valves 16, 17 so that when one inlet valve is open, the other inlet valve is closed, and vice versa. The outlet valves 18, 19 may be provided on outlet pipes 14, 15 extending between the condenser 10 and the cylinders 1, 2 respectively, and another mechanism may drive the outlet valves 18, 19 so that when one outlet valve is open, the other outlet valve is closed, and vice versa. The piston moves along the cylinder, and the outlet valve of each cylinder is connected with the condenser.

The inlet of cylinder 1 and that of cylinder 2 are connected to the compressor 3, in turn. A three-port valve 4, or a multi-port valve, is installed in the outlet of the compressor 3, and is connected to the inlet to the cylinders 1 and 2. When the refrigerant leaves the compressor 3, it will enter either cylinder 1 or cylinder 2.

The refrigerant flows through the compressor 3, which is an adiabatic isentropic compression process. The compressor 3 will cause the refrigerant to be compressed, until its pressure is equal to, or higher than, the atmospheric pressure of the airproof container 11.

When the refrigerant leaves the compressor 3, it will flows through the three-port valve 4 or the multi-port valve and enter the cylinder 1 or the cylinder 2. For example, the refrigerant enters the cylinder 1 first. At the start, the piston 7 is at the bottom of the cylinder 1, the outlet valve 18 of this cylinder is closed, the inlet valve 16 of this cylinder is opened, and it is connected to the compressor 3.

The refrigerant will enter the cylinder 1 from the compressor 3, when the piston 7 travels. The refrigerant input of the cylinder can be adjusted by adjusting the piston's displacement; the refrigerant input and the piston's displacement depend on the difference of flux between the compressor's outlet and the expansion valve. To determine the refrigerant input and the piston's displacement which the cylinder 1 needs first, when the piston's displacement is enough, the inlet valve 16 of the cylinder 1 is closed and the outlet valve 18 of this cylinder is opened. The outlet valve's opening can be adjusted, and the outlet valve 18 will be connected to the condenser 10 when it is opened. The inside pressure of the cylinder 1 will drop when the refrigerant enter the condenser 10. The atmospheric pressure 8 of the airproof container 11 will force the piston 7 to move, and can be utilized by the generator 100 and to produce electrical energy. The outlet valve 18 will be closed and the inlet valve 16 will be opened and connected to the compressor 3, when the piston 7 reaches the bottom of the air cylinder 1, the piston 7 will then push on towards the top of the air cylinder 1 again. The work which the atmospheric pressure does on the piston can be utilized by the generator during such a cycle.

When the inlet valve 16 of the cylinder 1 is closed, the inlet valve 17 of the cylinder 2 will be opened and connected with the compressor's outlet, the cylinder 2 will undergo the same processes. The other cylinders of the cylinders will also undergo the same processes.

As the refrigerant enters the condenser 10, it will release heat to the environment, via water or air, until its temperature is equal to that of the temperature of the environmental. The opening of the cylinder's outlet valve depends on the temperature of the environment, therefore by adjusting the outlet valve's opening, so that the inside pressure of the condenser 10 is equal to the refrigerant's liquefied pressure at the environmental temperature, the refrigerant will be liquefy in the condenser 10 in such an environmental temperature.

When the refrigerant leaves the condenser 10, it will enter the expansion valve 1; its pressure and temperature will drop. When the refrigerant leaves the expansion valve 1 it will enter the evaporator 2, where due to the work of the compressor 3, the inside pressure of the evaporator 2 will be low, the refrigerant will extract heat from the evaporator 2, until its temperature is equal to the environmental temperature, the refrigerant then leaves the evaporator 2, it will enter the compressor 3 again for the next cycle.

This invention uses a new-style cylinder, where the resistance is small. The new-style cylinder 35, 36 is installed in an airproof container 11. The new-style cylinder 35, 36 has the following main parts: the cylinder barrel 353, 363, the rod-less end-side cover or bottom cover 352, 362, the piston-rod end-side cover or top cover 351, 361, the piston 37, 39, the linear bearing 40 which is in the central of the piston-rod end-side cover 351, 361, and the corrugated tubular seal 90, which is between the top of the piston 37, 39 and the cylinder barrel 353, 363. The piston-rod end-side cover 351, 361 has an opening 354, 364; and the rod-less end-side cover 352, 362 has an inlet port 355, 365 and outlet port 356, 366, which are connected to the inlet valve 26, 27 and outlet valve 28, 29.

The new type of refrigeration apparatus's cylinder unit consists of these two new-style cylinders, which have a rod 50 connecting them. The movement of the cylinder is ganged together, when the piston of a cylinder runs to the bottom of this cylinder, the piston of the other cylinder will run to the top of that cylinder. This procedure can also be reversed.

The piston-rod 50 of this new-style cylinder has a pair of shifting yokes 52, which can open or close the four new-style valves 26, 27, 28, 29, by pushing the stopper 62, 72 of the new-style valve's rod 60, 70; when the inlet valve of a new-style cylinder is closed, its outlet valve will be opened. At the same time the other new-style cylinder's outlet valve will be opened, and the inlet valve closed. This procedure can also be reversed. The inlet and outlet of the new-style cylinders 35, 36 can be controlled by the switch on the four new-style valves 26, 27, 28, 29.

The new-style valve 26 has the following main parts: the cylinder barrel 263, the rod-less end-side cover or bottom cover 262, the piston-rod end-side cover or the top cover 261, the piston 37, the linear bearing 30 which is in the central of the piston-rod end-side cover 261, the corrugated tubular seal 90, which is between the top of the piston 265 and the cylinder barrel 263, and the conventional valve 82. The piston-rod end-side cover 261 has an opening 264, the rod-less side cover 262 has a conventional valve 82, and the one side of the valve stem 81 connects with the rod 60, the other side of the valve stem 81 connects with the valve core 80.

Two of the new-style valves 26, 27 are joined to the inlet of two new-style cylinders 35, 36, respectively, they form the inlet valve 26, 27 of the new-style cylinders. A rod 60 joins to the two valves. The movement of the valves is ganged together, when one valve is closed, the other valve will be open. The procedure can also be reversed. That is, when an inlet valve of a new-style cylinder is closed, the inlet valve of the other new-style cylinder will be opened. The procedure can also be reversed.

Two of the new-style valves 28, 29 are joined to the outlet of two new-style cylinders 35, 36, respectively, they form the outlet valve 28, 29 of the new-style cylinders. A rod 70 joins to the two valves. The movement of the valves is ganged together, when one valve is closed, the other valve will be open. The procedure can also be reversed. That is, when an outlet valve of a new-style cylinder is closed, the outlet valve of the other new-style cylinder will be opened. The procedure can also be reversed.

The shifting yoke 52 of the cylinder's piston-rod 50 has a loop, the direction of motion of the piston-rod 50 is perpendicular to the loop, when the piston-rod 50 moves, it will drive the loop to move, the magnet or excitation device is parallel to the direction of the motion of the piston-rod 50, when the loop is cutting the magnetic lines, it produces electrical energy.

DETAILED DESCRIPTION

Figure 1:
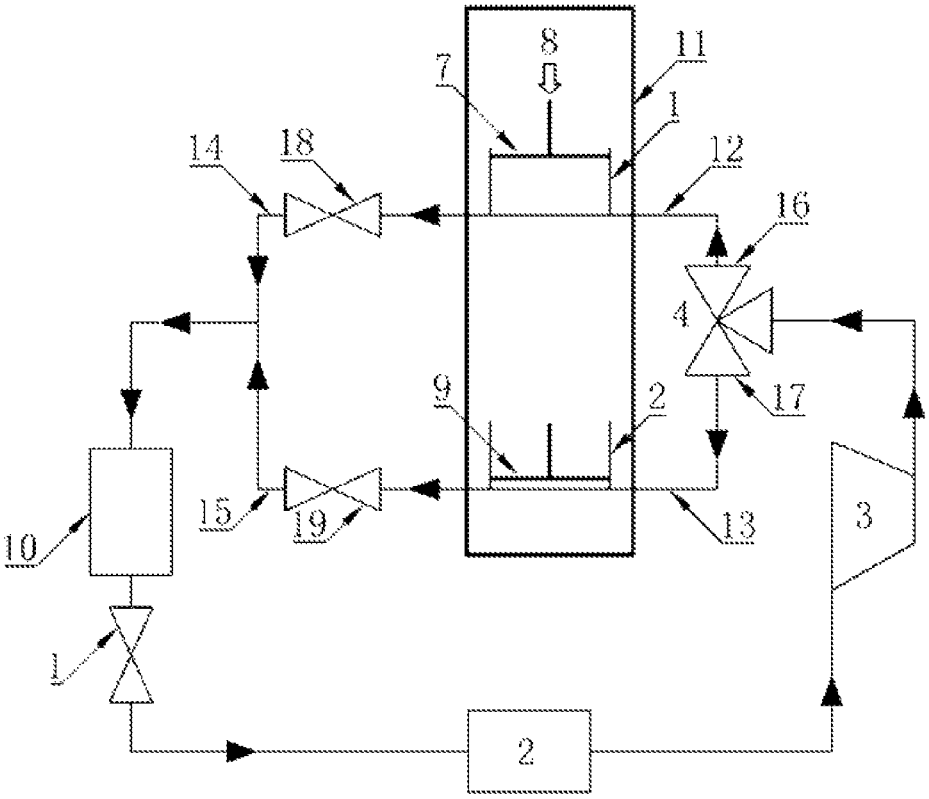
FIG. 1 is a schematic diagram of the new type refrigeration apparatus.
Figure 2:
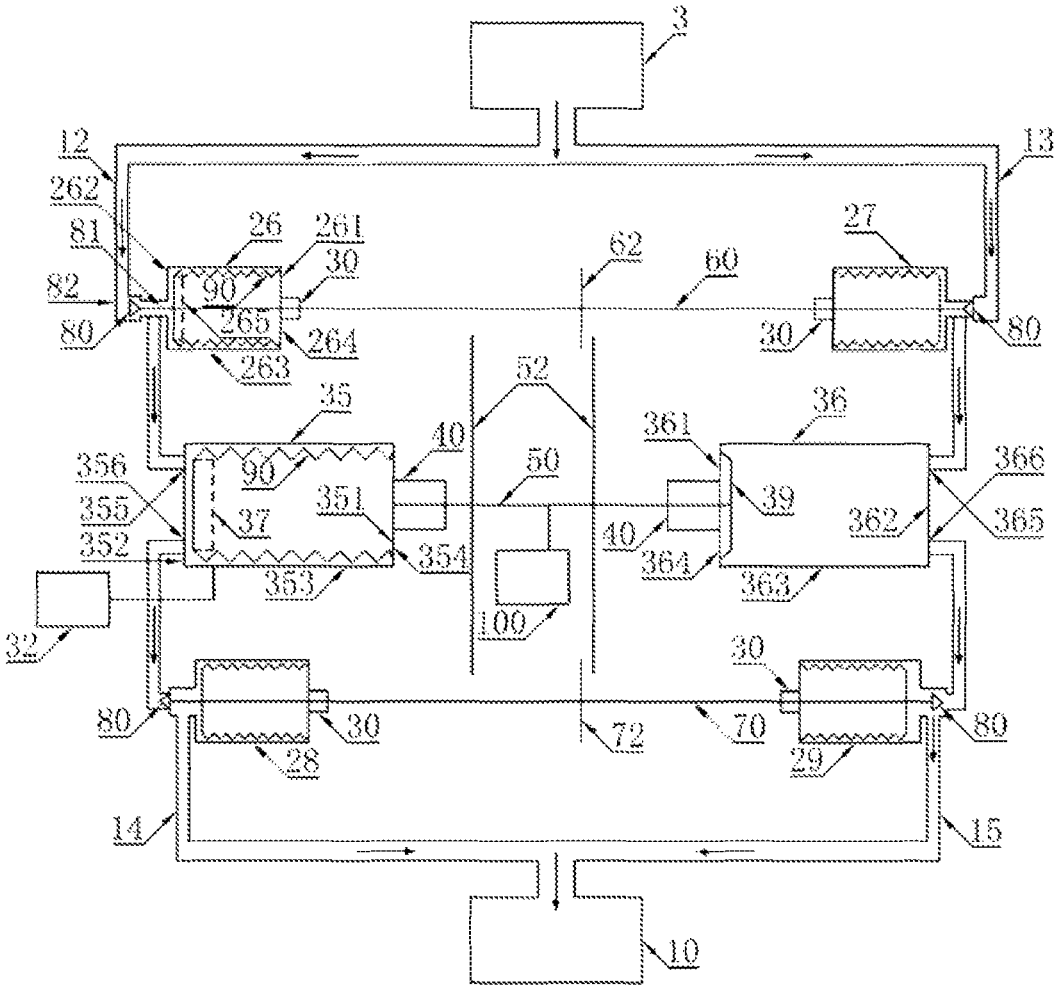
FIG. 2 is a schematic diagram of the new-style cylinders and the new-style valve of the new type refrigeration apparatus of present invention.

A specific embodiment is introduced in the following text, however, it is not intended to be limited to specific form set forth herein: see FIG. 1 and FIG. 2.

The new type of refrigeration apparatus is very similar, in some respects, to the traditional refrigeration apparatus, so the traditional refrigeration apparatus can be adapted to function as the new type of refrigeration apparatus.

In order to change the traditional refrigeration apparatus into the new type of refrigeration apparatus, a three-port valve 4, a cylinder unit 1, 2, and an airproof container 11 need to be installed, between the compressor's outlet and the condenser's inlet of the conventional refrigeration apparatus.

The cylinder unit consists of two cylinders 1, 2, and the material of these cylinders is a heat insulator. Each cylinder has an inlet valve 16, 17 and an outlet valve 18, 19. As the piston 7 moves along the cylinder 1, the outlet valve of each cylinder is connected to the condenser 10, and the three-port valve 4 is installed in the compressor's outlet and is connected with the cylinder's inlet valve.

A cylinder unit 1, 2 is installed in an airproof container 11. The airproof container 11 is filled with air. The atmospheric pressure of the airproof container 11 is higher than that of the refrigerant's liquefied pressure, at environmental temperature. The atmospheric pressure of the airproof container 11 is equal to that at the compressor's outlet. According to the environmental temperature, the pressure of the airproof container 11, and the pressure of the compressor's outlet, will be adjusted, so that the refrigerant can enter into the cylinder 1, 2 successfully, and can be liquefied in the condenser 10.

For example, if the refrigerant is ammonia, and if the environmental temperature is 30 degree centigrade, the pressure of the airproof container 11 should be greater than 1.1672 MPa, because ammonia will liquefy when the pressure is 1.1672 MPa and the temperature is 30 degree centigrade. Considering the friction loss when the ammonia flows through the pipe and the cylinder, the pressure of the airproof container 11 should be greater than 1.1672 MPa, so that the ammonia can be liquefied in the condenser 10.

The volume of the cylinder 1, 2 will depend on the difference of flux between the outlet of the compressor 3 and the expansion valve 1, the greater the difference of flux, the greater the volume of the cylinder 1, 2.

When the ammonia flows through the compressor 3, which is an adiabatic isentropic compression process, the compressor 3 will cause the refrigerant to be compressed, until its pressure is equal to the atmospheric pressure of the airproof container 11.

When the ammonia leaves the compressor 3, it will flow through the inlet valve of the cylinder 1, or that of the cylinder 2, and then enter cylinder 1, or cylinder 2. For example, when ammonia first enters cylinder 1. At the start, the piston at the bottom of this cylinder 1, the outlet valve of this cylinder 1 is closed; the inlet valve of this cylinder 1 is opened and is connected to the outlet of the compressor 3. When the ammonia enters cylinder 1 from the compressor 3, the starter 32 activates the piston to travel. This movement is similar to that of the inlet stroke of the Otto cycle. The movement of the cylinders is ganged together, when the piston of the cylinder 1 runs to the top of the cylinder 1, the piston of the cylinder 2 will run to the bottom of the cylinder 2. When the piston of the cylinder 1 runs to the top of the cylinder 1, its shifting yoke then closes the inlet valve, and opens the outlet valve, by pushing the stopper of the valve's rod. The outlet valve of the cylinder 1 will be opened and the cylinder 1 will be connected to the condenser 10. The inside pressure of the cylinder 1 will drop when the ammonia enters the condenser 10. The atmospheric pressure of the airproof container 11 will push the piston to move to the bottom of the cylinder 1. The outlet valve of the cylinder 1 will be closed and the inlet valve will be opened, and be connected with the compressor 3 when the piston reaches the bottom of the air cylinder 1, the piston will then, again, be pushed on towards the top of the air cylinder 1. The work which the atmospheric pressure does on the piston can be utilized by the generator and so produce electrical energy during such cycle.

When the inlet valve of the cylinder 1 is closed, the inlet valve of the cylinder 2 will be opened and connected with the compressor's outlet, and cylinder 2 will undergo the same processes.

When the piston-rod moves, it will cause the loop to move. When the loop cuts the magnetic lines, electrical energy is produced.

When ammonia enters the condenser, it will release heat to the environment, via water or air, until its temperature is equal to the environmental temperature. The ammonia will liquefy in the condenser.

When the ammonia leaves the condenser, it will enter the expansion valve; its pressure and temperature will drop. When the ammonia leaves the expansion valve it will enter the evaporator, due to the work of the compressor, the inside pressure of the evaporator will be low.

The ammonia will extract heat from the evaporator, until its temperature is equal to that of the environmental temperature. When the ammonia leaves the evaporator it will enter the compressor for the next cycle.

What is claimed is:

1. A refrigeration apparatus comprising:

(a) a compressor;

(b) a cylinder unit comprising at least a first cylinder and a second cylinder, each communicating with the compressor, the first and second cylinders being provided therein with a first piston and a second piston respectively;

(c) an airproof container enclosing the cylinder unit, and filled with air or other gas;

(d) a condenser communicating with the first and second cylinders;

(e) first and second inlet valves provided on first and second inlet pipes extending between the compressor and the first and second cylinders respectively, and a first mechanism driving the first and second inlet valves so that when the first inlet valve is open, the second inlet valve is closed, and vice versa;

(f) first and second outlet valves provided on first and second outlet pipes extending between the condenser and the first and second cylinders respectively, and a second mechanism driving the first and second outlet valves so that when the first outlet valve is open, the second outlet valve is closed, and vice versa; and (g) when the first inlet valve is open, the first outlet valve is closed, and the first piston is moved from a bottom end to a top end of the first cylinder, a refrigerant flows from the compressor into the first cylinder through the first inlet valve; and when the first inlet valve is closed, the first outlet valve is open, the refrigerant then flows from the first cylinder into the condenser through the first outlet valve, pressure in the first cylinder drops and atmospheric pressure in the airproof container forces the first piston to move from the top end to the bottom end; and when the first inlet valve is closed, the second inlet valve is open and the second cylinder undergoes a same process as the first cylinder;

(h) whereby the atmospheric pressure in the airproof container is utilized by both the first and second cylinders to produce electrical energy and compensate power consumption of the compressor.

2. The refrigeration apparatus as claimed in claim 1, wherein the first mechanism is a three-port valve or a multi-port valve.

3. The refrigeration apparatus as claimed in claim 1, further comprising a piston rod connecting between the first and second pistons such that piston-sides of the first and second cylinders are facing each other; and a pair of shifting yokes fixed on the piston rod.

4. The refrigeration apparatus as claimed in claim 3, wherein the first mechanism comprises a first valve rod having a first stopper provided at a central portion thereof, and first and second inlet valve cores provided at two opposite ends thereof for opening and closing first and second conventional valves respectively; and the second mechanism comprises a second valve rod having a second stopper provided at a central portion thereof, and first and second outlet valve cores provided at two opposite ends thereof for opening and closing third and fourth conventional valves respectively; the first and second stoppers being disposed between the pair of shifting yokes such that the shifting yokes engage and shift the first and second stoppers, thereby opening and closing the first and second inlet and outlet valves.

5. The refrigeration apparatus as claimed in claim 1, wherein each of the first and second cylinders comprises:

(a) a cylinder barrel;

(b) a top cover provided at a top end of the cylinder barrel;

(c) a linear bearing mounted at a center of the top cover through which the piston rod passes;

(d) an opening formed on the top cover;

(e) a bottom cover provided at a bottom end of the cylinder barrel;

(f) an inlet port and an outlet port formed on the bottom cover, and coupled with the first inlet pipe and the first outlet pipe respectively; and (g) a corrugated tubular seal provided between the piston and the cylinder barrel.

6. The refrigeration apparatus as claimed in claim 1, wherein each of the first and second inlet and outlet valves comprises:

(a) a cylinder barrel;

(b) a top cover provided at a top end of the cylinder barrel;

(c) a linear bearing mounted at a center of the top cover through which the valve rod passes;

(d) an opening formed on the top cover;

(e) a bottom cover provided at a bottom end of the cylinder barrel;

(f) a central opening formed on the bottom cover through which the end of the valve rod passes;

(g) a valve stem having one end coupled with the end of the valve rod and an opposite end coupled with the valve core; and (h) a corrugated tubular seal provided between the piston and the cylinder barrel.

7. The refrigeration apparatus as claimed in claim 1, wherein the pressure in the airproof container is equal to or higher than the refrigerant's liquefaction pressure at environmental temperature, and is equal to or lower than pressure at the compressor's outlet.

8. The refrigeration apparatus as claimed in claim 1, wherein the first and second cylinders comprise a heat-insulating material.

9. The refrigeration apparatus as claimed in claim 1, further comprising a starter coupled with the first and second pistons to activate movement thereof.

10. The refrigeration apparatus as claimed in claim 1, further comprising an expansion valve coupled with the condenser; and an evaporator coupled with the expansion valve, and wherein the compressor is coupled with the evaporator so that the refrigerant flows in a circle.

11. The refrigeration apparatus as claimed in claim 1, further comprising a generator coupled with the first and second cylinders.

* * * * *